US010667598B1

(12) United States Patent
Evans

(10) Patent No.: US 10,667,598 B1
(45) Date of Patent: Jun. 2, 2020

(54) SPORTS BAG COUPLING SYSTEM

(71) Applicant: Larry J. Evans, Dade City, FL (US)

(72) Inventor: Larry J. Evans, Dade City, FL (US)

( * ) Notice: Subject to any disclaimer, the term of this patent is extended or adjusted under 35 U.S.C. 154(b) by 0 days.

(21) Appl. No.: 16/113,693

(22) Filed: Aug. 27, 2018

Related U.S. Application Data

(60) Provisional application No. 62/662,319, filed on Apr. 25, 2018.

(51) Int. Cl.
*A45F 3/04* (2006.01)
*A63B 71/14* (2006.01)
*A45F 3/00* (2006.01)

(52) U.S. Cl.
CPC ..... *A45F 3/04* (2013.01); *A63B 71/141* (2013.01); *A45F 2003/003* (2013.01)

(58) Field of Classification Search
CPC ..... A45F 3/04; A45F 2003/003; A63B 71/141
USPC ..... 224/645
See application file for complete search history.

(56) References Cited

U.S. PATENT DOCUMENTS 4,403,366 A * 9/1983 Lucke ..... A41D 13/0015 15/209.1
4,532,656 A * 8/1985 Suzuki ..... A41D 27/20 2/247
5,119,979 A * 6/1992 Kallman ..... G02C 3/04 2/271
5,177,881 A * 1/1993 Moore ..... A63B 55/408 206/315.3
6,499,227 B1 * 12/2002 Jacobson ..... D06F 59/04 34/104
6,546,599 B2 * 4/2003 Pelt ..... A45F 5/022 24/3.1
6,694,575 B1 * 2/2004 Martin ..... A45F 5/02 206/315.3
8,701,216 B1 * 4/2014 Evans ..... A41D 19/0037 2/161.2
9,216,342 B1 * 12/2015 Evans ..... A63B 71/0036
2002/0138953 A1 * 10/2002 Passafiume ..... A45F 5/00 24/306
2003/0029006 A1 * 2/2003 Pelt ..... A45F 5/022 24/303
2005/0120579 A1 * 6/2005 Nicholson ..... A63B 71/146 34/106
2006/0086629 A1 * 4/2006 Cacioppo, Jr. ..... A41D 19/0041 206/289
2006/0151562 A1 * 7/2006 Moor ..... A45F 3/14 224/660
2009/0178175 A1 * 7/2009 McCrary ..... A45F 5/02 2/161.6

* cited by examiner

*Primary Examiner* — Peter N Helvey

(57) ABSTRACT

A sports bag coupling system comprising a sports bag; a sports glove; and a connector including hook and loop fasteners separably coupling the sports glove and the sports bag.

2 Claims, 2 Drawing Sheets

FIG. 3
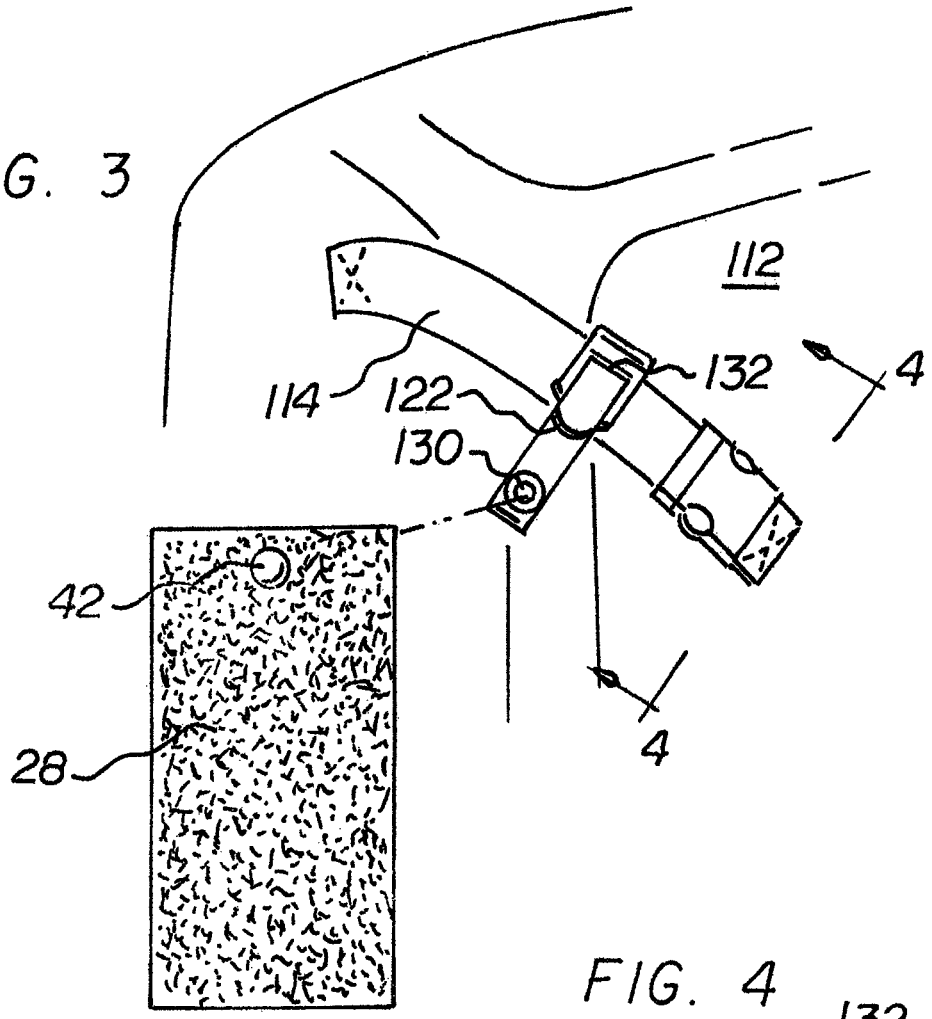
FIG. 4
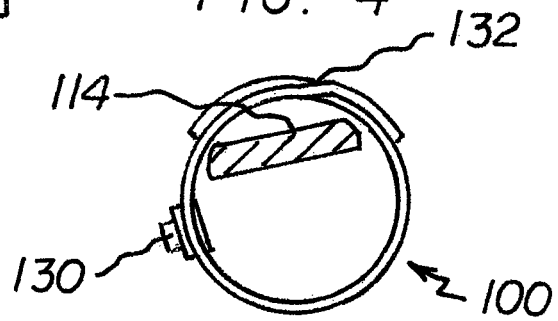
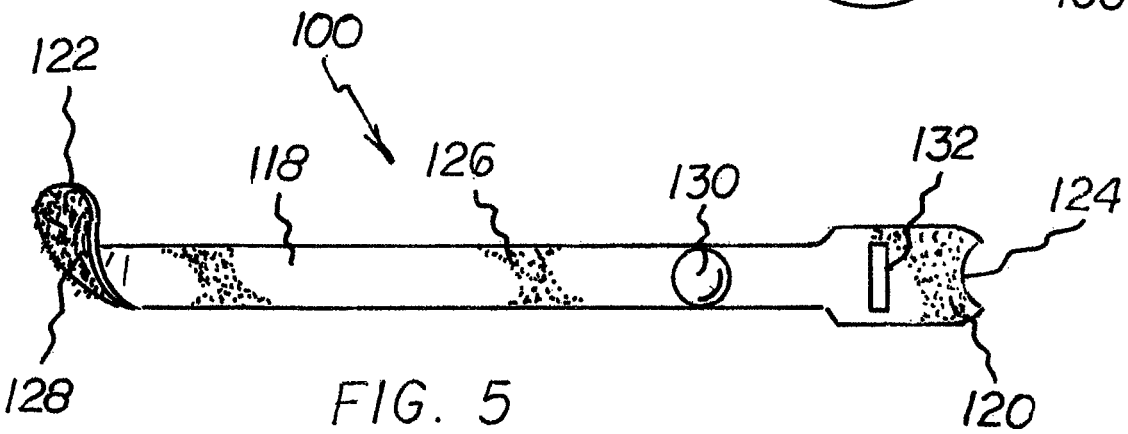
FIG. 5

SPORTS BAG COUPLING SYSTEM

RELATED APPLICATION

The present application is based upon Provisional Application No. 62/662,319 filed Apr. 25, 2018, the subject matter of which is incorporated herein by reference and the priority of which is hereby claimed.

BACKGROUND OF THE INVENTION

Field of the Invention

The present invention relates to a sports bag coupling system and more particularly pertains to separably coupling a sports glove to a sports bag.

Description of the Prior Art

The use of sports bags and gloves is known in the prior art. More specifically, sports bags and gloves previously devised and utilized for the purpose of transporting sports gear are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, they do not describe a sports bag coupling system that allows for attaching sports gloves to sports bags for the purpose of maintaining gloves in a readily accessible location.

In this respect, the sports bag coupling system according to the present invention substantially departs from the conventional concepts and designs of the prior art, and in doing so provides an apparatus primarily developed for the purpose of storing and maintaining the integrity of the sports glove.

Therefore, it can be appreciated that there exists a continuing need for a new and improved sports bag coupling system which can be used for separably coupling a sports glove to a sports bag. In this regard, the present invention substantially fulfills this need.

SUMMARY OF THE INVENTION

In view of the disadvantages inherent in the known types of sports bags and gloves now present in the prior art, the present invention provides an improved sports bag coupling system. As such, the general purpose of the present invention, which will be described subsequently in greater detail, is to provide a new and improved sports bag coupling system and method which has all the advantages of the prior art and none of the disadvantages.

To attain this, for a broad perspective, the present invention essentially comprises a sports bag and a sports glove and a coupler with hook and loop fasteners there between.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sports bag coupling system which has all of the advantages of the prior art sports bags and gloves and none of the disadvantages.

It is another object of the present invention to provide a new and improved sports bag coupling system which may be easily and efficiently manufactured and marketed.

It is a further object of the present invention to provide a new and improved sports bag coupling system which is of durable and reliable constructions.

An even further object of the present invention is to provide a new and improved sports bag coupling system which is susceptible of a low cost of manufacture with regard to both materials and labor, and which accordingly is then susceptible of low prices of sale to the consuming public, thereby making such sports bag coupling system economically available to the buying public.

Lastly, it is an object of the present invention to provide a sports bag coupling system for separably coupling a sports glove to a sports bag through hook and loop fasteners.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the sports bag sports bag coupling strap on a sports bag.

FIG. 4 is an enlarged view of the sports bag coupling strap taken along line 4-4 of FIG. 3.

FIG. 5 is a front elevational view of the strap of FIGS. 3 and 4.

The same reference numerals refer to the same parts throughout the various Figures.

DESCRIPTION OF THE PREFERRED EMBODIMENT

Figure 1:
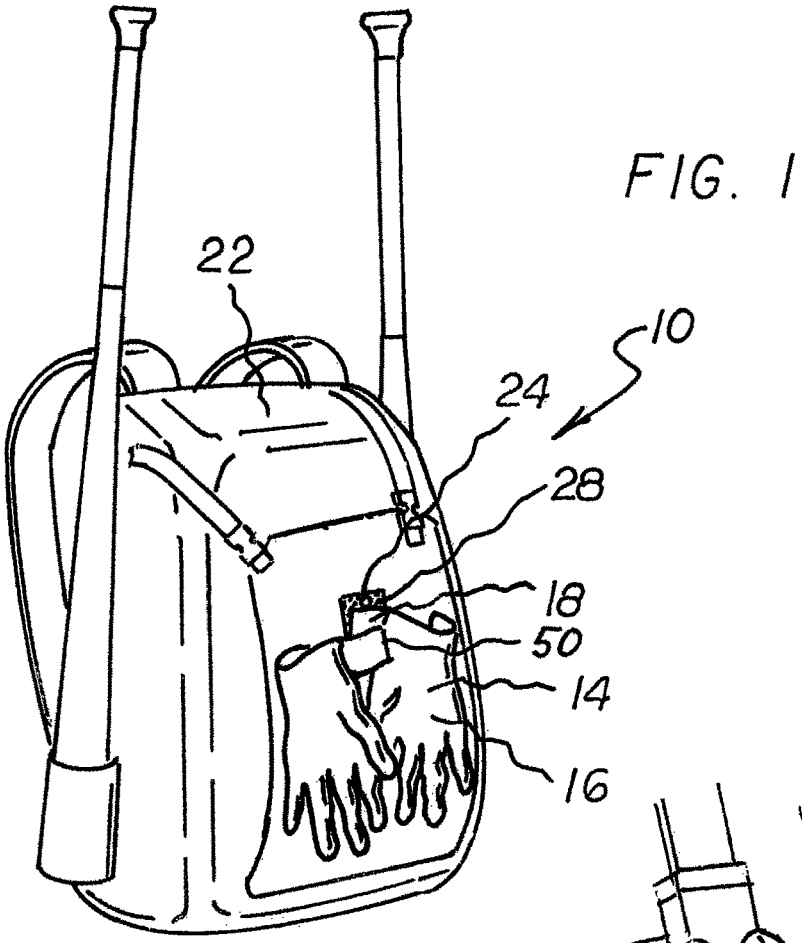
FIG. 1 is a perspective illustration of a sports bag coupling strap constructed in accordance with the principles of my prior invention.
Figure 2:
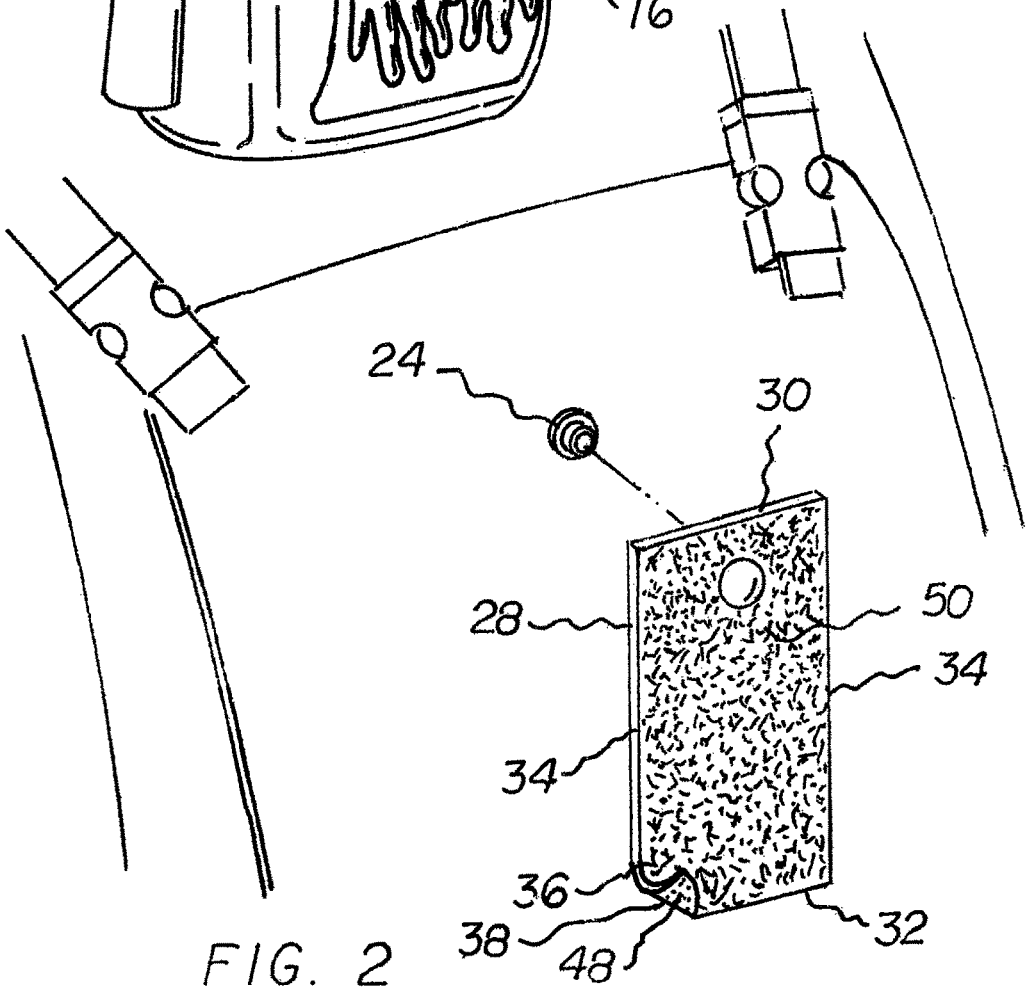
FIG. 2 is an exploded perspective illustration of a portion of the system shown in FIG. 1.

With reference now to the drawings, the embodiments of the new and improved grip-it sports method and system embodying the principles and concepts of the present invention and generally designated by the reference numeral 100 will be described.

The present invention, the sports bag coupling system is comprised of a plurality of components which in their broadest context include a sports bag and a sports glove and a coupler there between. Such components are individually configured and correlated with respect to each other so as to attain the desired objective. Sports bags include golf bags, baseball bags, softball bags, football bags, and the like. Typical contents for a sports bag include golf clubs, foot wear, head wear, mitts, and the like.

First provided is a sports glove 14. The sports glove has a hand covering section 16. The hand covering section is positionable over the fingers and palm of a wearer. The sports glove has a strap section 18. The strap section is positionable adjacent to a wrist of the wearer.

A sports bag 22 is provided. The sports bag has an upper peripheral area with a handle. The upper peripheral area has a plurality of male snap fasteners 24. The male snap fasteners project outwardly from the upper peripheral area.

A rectangular connector 28 is provided next. The connector has a linear top edge 30. The connector has a parallel linear bottom edge 32. The top and bottom edges are separated by a length of between 5 and 7 inches. The connector has linear parallel side edges 34. The side edges are separated by a width of between 2 and 4 inches. The connector has an upper surface 36. The connector has a parallel lower surface 38. The upper and lower surfaces are separated by a thickness. The connector is fabricated of a flexible, essentially inextensible fabric.

Further provided is a first female snap fastener 42. The first female snap fastener extends from the upper surface adjacent to the top edge. The first female snap fastener is separably coupled to one of the male snap fasteners. In this manner the connector will hang from a user-selected area of the sports bag.

Provided last is a first patch 48 of a hook and loop fastener. The first patch is secured to the lower surface of the connector. The first patch is of a hook orientation. A second patch 50 of a hook and loop fastener is provided. The second patch is secured to the upper surface of the connector. The second patch is of a loop orientation. A third patch 52 of a hook and loop fastener is provided. The third patch is secured to the strap of the glove. The third patch is adapted to separably couple to the first and second patches of the connector. The system of my prior invention also includes a sports bag.

Some sports bags do not have snaps as descried above. In such cases, the present invention, as shown in FIGS. 3-5, includes a sports bag coupling strap which comprises a long section and a short section. The long section and the short section are integrally fabricated. The long section has a long end terminating in a convex shape. The short section has a short end terminating in a concave shape. A central axis extends through the long section and the short section. The sports bag coupling strap has a front side and a rear side with hook and loop fasteners on the front side and on the rear side. A male snap is on the front side. A slot extends through the short section perpendicular to the central axis for the passage of the long section with the female snap exposed. The long section is between 3 and 4 times longer than the short section.

The sports bag coupling strap further includes 1) a sports bag with a handle removably receiving the strap; 2) a hook and loop connector with a snap coupled to the male snap of the strap; and 3) a sports glove coupled to the hook and loop connector.

In a more specific sense, the present invention includes a sports bag coupling strap 100 separably coupling a sports glove to a sports bag 112). The sports bag is of the type having a handle 114 but no male snap.

The sports bag coupling strap comprises a long section 118 and a short section 120. The long section and the short section are integrally fabricated. The long section has a long end 122 terminating in a convex shape. The short section has a short end 124 terminating in a concave shape. The long section and the short section together have a total length of 6 inches, plus or minus 10 percent. The long section has a long length of 4.375 inches, plus or minus 10 percent. The short section has a short length of 1.25 inches, plus or minus 10 percent. A central axis extends through the long section and the short section. The sports bag coupling strap has a front side 126 and a rear side 128. Hook and loop fasteners are on the front side and the rear side. A male snap 130 is on the front side.

A slot 132 extends through the short section perpendicular to the central axis for the passage of the long section with the female snap exposed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sports bag coupling system comprising:

a sports bag (22);

a sports glove (14);

a connector (28) including hook and loop fasteners separably coupling the sports glove and the sports bag, a female snap (42) secured to the connector; and a strap (100) having a long section (118) and a short section (120), the long section and the short section being integrally fabricated of a flexible material, the long section having a long end (122) terminating in a convex shape, the short section having a short end (124) terminating in a concave shape, the long section and the short section together having a total length, the long section having a long length, the short section having a short length less than the long length, a central axis extending through the long section and the short section, the long section having parallel edges with a width there between, the short section having parallel edges with a width there between, the width of the short section being greater than the width of the long section, the strap having a front side (126) and a rear side (128), hook and loop fasteners on the front side and the rear side, a male snap (130) on the front side, a slot (132) extending through the short section perpendicular to the central axis for the passage of the long section with the female snap exposed for separably coupling to the connector.

2. A sports bag coupling system comprising, in combination:

a sports glove (14) having a hand covering section (16) positionable over fingers and palm of a wearer, the sports glove having a strap section (18) positionable adjacent to a wrist of the wearer;

a sports bag (22) having an upper peripheral area with a handle;

a connector (28) in a rectangular configuration having a linear top edge (30) and a parallel linear bottom edge (32) separated by a length of between 5 and 7 inches, the connector having linear parallel side edges (34) separated by a width of between 2 and 4 inches, the connector having an upper surface (36) and a parallel lower surface (38), the upper and lower surfaces separated by a thickness, the connector being fabricated of a flexible, essentially inextensible fabric, a female snap fastener (42) secured to the connector adjacent to the top edge;

a first patch (48) of hook and loop fasteners secured to the lower surface of the connector, a second patch (50) of hook and loop fasteners secured to the upper surface of the connector, a third patch (52) of hook and loop fasteners secured to the strap section of the glove, the third patch adapted to separably couple to the first and second patches of the connector; and a strap (100) having a long section (118) and a short section (120), the long section and the short section being integrally fabricated of a flexible material, the long section having a long end (122) terminating in a convex shape, the short section having a short end (124) terminating in a concave shape, the long section and the short section together having a total length of 6 inches, plus or minus 10 percent, the long section having a long length of 4.375 inches, plus or minus 10 percent, the short section having a short length of 1.25 inches, plus or minus 10 percent, a central axis extends through the long section and the short section, the long section having parallel edges with a width there between, the short section having parallel edges with a width there between, the width of the short section being greater than the width of the long section, the strap having a front side (126) and a rear side (128), hook and loop fasteners on the front side and the rear side, a male snap (130) on the front side, a slot (132) extending through the short section perpendicular to the central axis for the passage of the long section with the male snap exposed for separably coupling to the connector.

* * * * *